US005317371A

United States Patent [19]

Monma et al.

[11] Patent Number: 5,317,371

[45] Date of Patent: May 31, 1994

[54] SKEW PREVENTION STRUCTURE FOR ELECTROPHOTOGRAPHIC PRINTER

[75] Inventors: Yoshio Monma, Ooi; Hiroyuki Yamaguchi, Tokyo, both of Japan

[73] Assignee: Asahi Kogaku Kogyo Kabushiki Kaisha, Tokyo, Japan

[21] Appl. No.: 949,369

[22] Filed: Sep. 23, 1992

Related U.S. Application Data

[63] Continuation of Ser. No. 683,550, Apr. 10, 1991, abandoned.

[30] Foreign Application Priority Data

Apr. 13, 1990 [JP] Japan ..... 2-97882

[51] Int. Cl.[5] ..... G03G 15/14

[52] U.S. Cl. ..... 355/274; 355/271; 355/309

[58] Field of Search ..... 355/271, 274, 277, 309, 355/308-313, 315, 219, 276; 271/208, 303; 361/214, 221

[56] References Cited

U.S. PATENT DOCUMENTS

| | | | |
|---|---|---|---|
| 4,839,697 | 6/1989 | Kamitamari et al. | 355/309 |
| 4,843,429 | 6/1989 | Avritt et al. | 355/274 |
| 4,929,982 | 5/1990 | Ainoya et al. | 355/311 |
| 4,943,863 | 7/1990 | Ainoya | 355/271 |
| 4,987,448 | 1/1991 | Chikama | 355/205 |
| 4,994,861 | 2/1991 | Brandon et al. | 355/274 |
| 5,045,892 | 9/1991 | Morisawa et al. . | |

FOREIGN PATENT DOCUMENTS

| | | | |
|---|---|---|---|
| 0082254 | 6/1983 | European Pat. Off. | 355/274 |
| 0343948 | 11/1989 | European Pat. Off. . | |
| 2734314 | 2/1978 | Fed. Rep. of Germany . | |
| 3929117 | 3/1990 | Fed. Rep. of Germany . | |
| 0137178 | 6/1986 | Japan | 355/274 |
| 61-137178 | 6/1986 | Japan . | |
| 0090675 | 4/1987 | Japan | 355/274 |
| 63-271380 | 11/1988 | Japan . | |
| 5581375 | 11/1988 | Japan . | |
| 0108090 | 4/1990 | Japan | 355/274 |

OTHER PUBLICATIONS

English Language Translation of German Office Action dated Mar. 1, 1993.

Patent Abstracts of Japan P-514, P-836, and P-27.

*Primary Examiner*—A. T. Grimley

*Assistant Examiner*—T. A. Dang

*Attorney, Agent, or Firm*—Sandler Greenblum & Bernstein

[57] ABSTRACT

In an electrophotographic printer, a guide member is arranged at the upstream side of the record medium feed path with respect to the transfer charger for shifting the recording medium towards the photoconductive drum by a predetermined amount. A conductive brush member, which is grounded, is arranged at the downstream side of the feed path with respect to the transfer charger for shifting the recording medium towards the photoconductive drum by another predetermined amount.

13 Claims, 2 Drawing Sheets

SKEW PREVENTION STRUCTURE FOR ELECTROPHOTOGRAPHIC PRINTER

This application is a continuation of application Ser. No. 07/683,550, filed Apr. 10, 1991, now abandoned.

BACKGROUND OF THE INVENTION

The present invention relates to a skew prevention structure of an electrophotographic printer for preventing the skew of a recording medium due to the winding of the recording medium around a photoconductive drum.

Conventionally, there has been known an electrophotographic image forming apparatus such as a copy machine and printer employing a so-called electrophotographic image forming process. In the electrophotographic image forming apparatus, the uniformly charged photoconductive material provided on the surface of a photoconductive drum is exposed to light, carrying an image data, to form a latent image. The latent image is developed by adhering toner thereto (a toner image is formed), and the toner image is transferred onto a recording medium and fixed.

Some of the electrophotographic printers print images onto a so-called fanfold recording sheet which is a continuous recording sheet provided with perforated tear lines, which are defined at the portions to be folded. Hereinafter, this continuous form recording sheet is simply abbreviated as a continuous sheet. The continuous sheet can be easily cut off at the perforated tear lines.

Incidentally, in the electrophotographic image forming apparatus, a so-called heat roll fixing process is generally employed.

In the heat roll fixing process, a pair of fixing rollers comprising a heat roller heated to a high temperature and a press roller are arranged such that the rotational axis of the press roller is in parallel to that of the heat roller, and the recording sheet carrying an unfixed toner image thereon, is nipped between the pair of fixing rollers. The unfixed toner image on the recording sheet is fused by being heated with a heated roller (heat roller), and fixed onto the recording sheet at a fixing station. The heat roll fixing process is advantageous in that excellent energy efficiency is realized and a fixing speed can be increased.

The fixing station also functions as a feed means to feed the recording sheet nipped between the pair of fixing rollers. Usually, the heat roller is rotatably driven, and the press roller is driven to be rotated in accordance with the rotation of the heat roller.

FIG. 2 shows an example of a laser beam printer for printing images onto a continuous sheet employing the electrophotographic image forming process. The laser beam printer comprises a toner cleaner 2, discharging station 3, charging station 4, scanning optical system 5 for emitting a scanning laser beam onto a photoconductive drum 1, a developing station 6, and a transferring station 7 around the photoconductive drum 1 along the rotational direction thereof. Further, a fixing station 8 is disposed at the position in which the continuous sheet 9 is fed. A tractor 10 is disposed between the photoconductive drum 1 and the fixing station 8. The tractor 10 is driven by the continuous sheet 9 as the continuous sheet 9 is fed. The tractor 10 applies a predetermined amount of tension to the continuous sheet 9 as it is fed from the photoconductive drum 1 to the fixing station 8.

Incidentally, in the electrophotographic image forming apparatus as described above, when a printing ratio is lowered (e.g., 5% or less), the continuous sheet is attracted around the circumferential surface of the photoconductive drum in a relatively wide area and thus a problem arises in that so-called skew occurs (the continuous sheet proceeds obliquely or windingly), wherein the printing ratio is the proportion of the area to which toner is applied to the printable area on the continuous sheet 9.

At the transferring station in the electrophotographic image forming apparatus, a recording sheet is charged to a reverse polarity with respect to that of the toner attracted on the photoconductive drum by a charger, such as a corona charger or the like, so that the toner on the surface of the photoconductive drum is electrically attracted and transferred to the recording sheet.

In the case of discharged area development as in the printer, the surface of the photoconductive drum is charged at the same polarity as that of the toner. When a printing ratio is low, and accordingly, the amount of the toner attracted onto the circumferential surface of the photoconductive drum is small, the recording sheet easily attracted to the circumferential surface thereof. However, the amount of the recording sheet attracted to the photoconductive drum (winding length, or the length of the area of the recording sheet winding around or contacting the circumferential surface of the photoconductive drum) depends upon the amount of toner on the recording sheet (image pattern), and the difference of the charged amount due to the irregular quality of a recording sheet and different humidity.

Accordingly, the recording sheet is not uniformly wound around the photoconductive drum in the axial direction of the photoconductive drum and thus the winding length is partially different.

Further, it is very difficult to make the peripheral speed of the photoconductive drum to be accurately equal to the feeding speed of the continuous sheet. As a result, in the situation when a continuous sheet is used as the recording sheet and the continuous sheet is fed by the fixing rollers, a difference of tension is caused in the width direction of the continuous sheet between the photoconductive drum and the fixing station. Thus the feeding amount of the continuous sheet in the width direction varies due to the difference of the tension applied thereto, and as a result, the skew of the continuous sheet occurs.

More specifically, the continuous sheet tends to proceed obliquely toward the side where the winding length is smaller because the portion of the continuous sheet in which winding length is long is more affected by the rotation of the photoconductive drum.

Once the skew arises, the position of the continuous sheet is taken in the fixing station (fixing roller pair) inclines more, and more and finally a jam is caused.

SUMMARY OF THE INVENTION

It is therefore an object of the present invention to provide a skew prevention structure for an electrophotographic printer that is capable of preventing a skew due to the excessive winding of a continuous sheet around the circumferential surface of a photoconductive drum by regulating the length of the continuous sheet winding around the photoconductive drum within a range needed to obtain a sufficient transfer quality.

For the above object, according to the present invention, there is provided an electrophotographic printer comprising a photoconductive drum, and a transfer charger. A feed path of the recording medium is defined between the photoconductive drum and said transfer charger. A latent image is formed on the circumferential surface of the photoconductive drum by exposing the surface to light, carrying an image data. A toner image being formed by applying toner to the latent image. The recording medium is charged by the transfer charger so that the toner image is transferred from the photoconductive drum to a recording medium. The printer further comprises:

A first shifting device arranged at the upstream side of the feed path with respect to the transfer charger for shifting the recording medium to the photoconductive drum by a predetermined amount.

A second shifting device arranged at the downstream side of the feed path with respect to the transfer charger for shifting the recording medium to the photoconductive drum by another predetermined amount.

Optionally, the second shifting device is conductive and grounded, whereby the electrical potential of the recording medium is grounded. Thus, the recording medium is prevented from electrically being attracted and thus, winding around the circumferential surface of the photoconductive drum due to the charge thereof.

Further, the second shifting device comprises a brush member. Thus the recording medium is efficiently discharged by the brush member.

Further optionally, the electrophotographic printer further comprises a feed path defining device for regulating the feed path so that the feed path neutrally parts from the photoconductive drum. The first and second shifting devices cause the recording medium to abut against the circumferential surface of the photoconductive drum.

Furthermore, the recording medium is a continuous form recording sheet.

DESCRIPTION OF THE ACCOMPANYING DRAWINGS

FIG. 1 is a partial side view of the transferring station of an electrophotographic printer employing a skew prevention structure embodying the present invention; and FIG. 2 is a schematic side view of an example of a laser beam printer.

DESCRIPTION OF THE EMBODIMENTS

Figure 1:
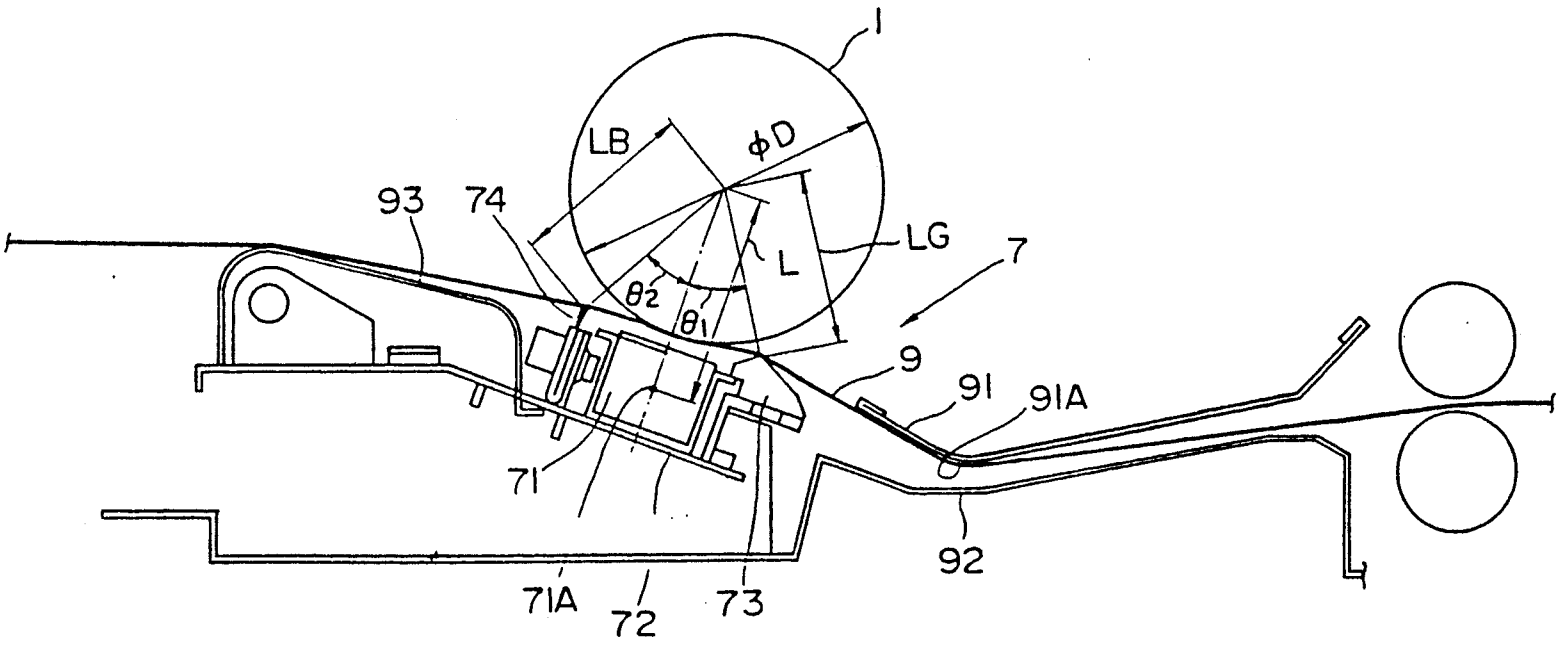
Figure 2:
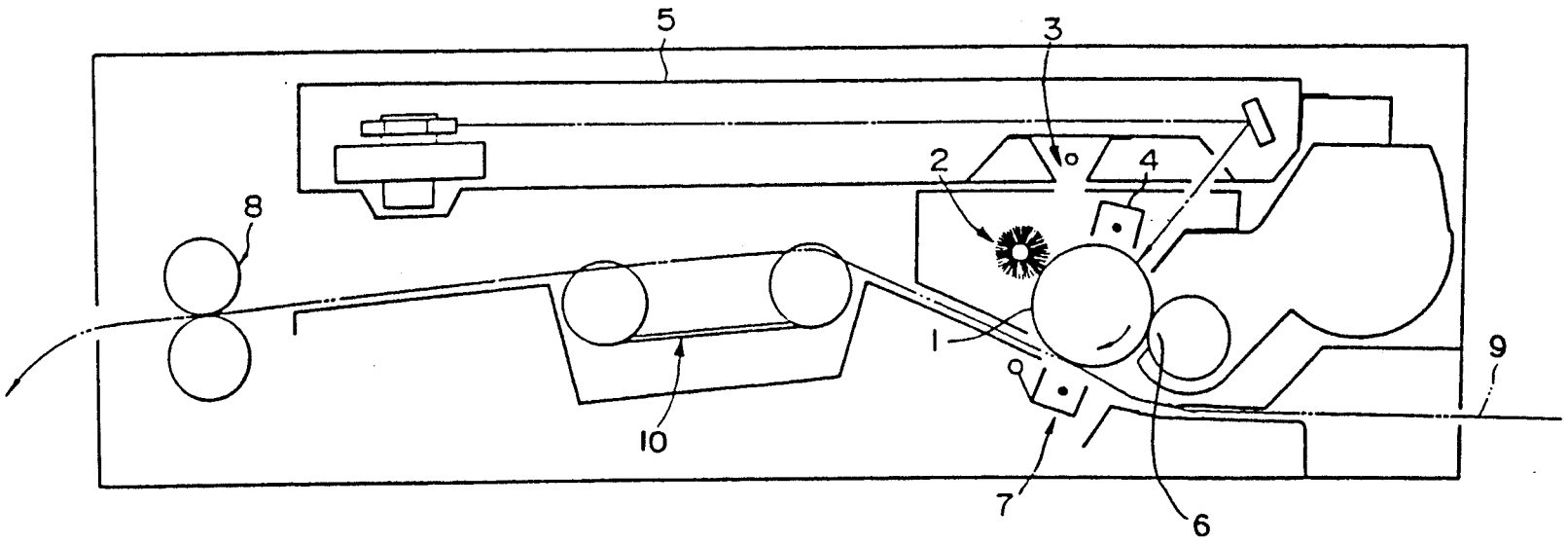

FIG. 1 is a side view of the transferring station of an electrophotographic printer using a continuous sheet employing a skew prevention structure according to the present invention.

A transferring station 7 of the electrophotographic printer comprises a corona charger 71 supported by a metal arm 72, which is disposed below a photoconductive drum 1 and confronting the circumferential surface thereof.

A continuous sheet feed path is defined between the corona charger 71 and the photoconductive drum 1. A continuous sheet 9 is fed by a fixing station (not shown) disposed on the left hand side in FIG. 1 so that the continuous sheet 9 is fed from the right side to the left side.

The metal arm 72, supporting the corona charger 71, is provided with a pressing guide 73, as a pressing member, disposed on the upstream side of the sheet feed path with respect to the corona charger 71. A discharging brush 74 is disposed on the downstream side of the sheet feed path with respect to the metal arm 72. Both the pressing guide 73 and the discharging brush 74 are located adjacent to the corona charger 71.

The pressing guide 73 has a peak upper side and is disposed with the peaked upper side projecting from the plane, including the upper surface of the corona charger 71, toward the photoconductive drum 1.

The discharging brush 74 is a brush composed of bundled conductive fibers. Whereby the charge of the continuous sheet that is in contact with the discharging brush 74 is grounded. The discharging brush 74 is conductively mounted to the metal arm 72 with the extreme end thereof projecting from the plane of the upper surface of the corona charger 71 toward the photoconductive drum 1. Constructed as above, the length of the continuous sheet 9 winding around the photoconductive drum 1, due to the charging condition of the continuous sheet 9, can be regulated.

Continuous paper guides 91, 92 are arranged at the upstream side of the sheet feed path with respect to the transferring station 7. A cover 93 for guiding the continuous sheet 9, is provided above the metal arm 72 which is located on the downstream side of the sheet feed path.

The continuous sheet guides 91, 92 form a continuous sheet path having a predetermined gap defined by the upper and lower guides 91, 92. The upper guide 91 is curved toward the portion where the continuous sheet 9 contacts the photoconductive drum 1.

Assuming here that the transferring station 7 is not used (when the transferring station 7 is ignored), the line connecting the curved portion 91A of the upper guide 91 to the uppermost portion of the cover 93 would define a virtual continuous sheet feed path. The actual continuous sheet feed path is formed such that the virtual continuous sheet feed path is curved to the photoconductive drum 1 side by the transferring station 7 (i.e., by the pressing guide 73 and the discharging brush 74 projecting from the plane of the upper surface of the corona charger 71 to the photoconductive drum 1 side). More specifically, the line connecting the pressing guide 73 to the upper end of the discharging brush 74 defines the actual continuous sheet feed path (practically, the discharging brush 74 is slightly bent).

With the transferring station 7 arranged as above, the continuous sheet 9, which is fed from the right hand side, to the left hand side in FIG. 1 by the fixing station, is charged by the corona charger 71 to a polarity opposite to the polarity of the toner, forming a toner image on the circumferential surface of the photoconductive drum 1. Thus the toner image is electrically attracted and transferred onto the continuous sheet 9.

As above, the continuous sheet 9 is pressed to the photoconductive drum 1 by the pressing guide 73 and discharging brush 74 which are located at the upstream and downstream sides of the sheet feed path, respectively, with the corona charger 71 therebetween. Therefore, the length of the continuous sheet 9, winding around or contacting the photoconductive drum 1 can be regulated by adjusting the positions of the peaked portion of the pressing guide 73 and the extreme end of the discharging brush 74. In other words, a minimum contact width of the continuous sheet 9 with the photoconductive drum 1 can be set so that the sufficient transfer quality is obtained, even if the printing ratio is low, the continuous sheet 9 is prevented from excessively winding around the circumferential surface of the photoconductive drum 1 by adjusting the positions of the peaked portion of the pressing guide 73 and the extreme end of the discharging brush 74.

In an experiment, the winding length of the continuous sheet 9 with the photoconductive drum, 1 for obtaining a sufficient transfer quality, has been formed. Further the continuous sheet 9 has been prevented from excessively winding around the circumferential surface of the photoconductive drum 1 even if the printing ratio was low, wherein the following parameters were used in the experiment:

diameter D of the photoconductive drum 1 is 40 mm;

a distance L between the center of the photoconductive drum 1 and the charger wire 71A of the corona charger 71 is 27 mm;

the angle $\theta_1$ between the center of the corona charger 71 and the upper end of the pressing guide 73, with respect to the center of the photoconductive drum 1, is 30 degrees;

the distance LG from the center of the photoconductive drum 1 to the upper end of the pressing guide 73 is 22 mm;

the angle $\theta_2$ between the center of the corona charger 71 and the upper end of the discharging brush 74, with respect to the center of the photoconductive drum 1, is 30 degrees; and the distance LB, from the center of the photoconductive drum 1 to the upper end of the discharging brush 74, is 24 mm.

With this arrangement, a difference of the length of the continuous sheet 9 winding around the photoconductive drum 1 in the axial direction of the photoconductive drum can be prevented when the printing ratio is low. Thus, the skew caused by a difference of the tension in the width direction of the continuous sheet 9, between the photoconductive drum 1 and the fixing station, due to the uneven winding length in the axial direction of the photoconductive drum can be prevented.

As described above, according to the skew prevention structure for an electrophotographic printer embodying the present invention, the length of the continuous sheet winding around the photoconductive drum can be minimized in the range in which a sufficient transfer quality can be obtained. The skew caused by the excessive winding of the continuous sheet around the photoconductive drum can be prevented by making the length of the continuous sheet winding around the photoconductive drum, at any portions in the axial direction of the photoconductive drum, uniform.

The present disclosure relates to a subject matter contained in Japanese patent application No. HEI 2-97882 (filed on Apr. 13, 1990) which is expressly incorporated herein by reference in its entirety.

What is claimed is:

1. An electrophotographic printer comprising a photoconductive drum, and a transfer charger, a feed path of a recording medium being defined between said photoconductive drum and said transfer charger, a latent image being formed on the circumferential surface of said photoconductive drum by exposing said surface to light carrying image data, a toner image being formed by applying toner to said latent image, said recording medium being charged by said transfer charger so that said toner image is transferred from said photoconductive drum to said recording medium, said printer further comprising:

first shifting means arranged at the upstream side of said feed path with respect to said transfer charger for shifting said recording medium to said photoconductive drum by a predetermined amount; and second shifting means arranged at the downstream side of said feed path with respect to said transfer charger for shifting said recording medium to said photoconductive drum by another predetermined amount, wherein said first shifting means and said second shifting means press said recording medium along a predetermined width of said photoconductive drum, such that a straight line formed by interconnecting said first and second shifting means intersects said circumferential surface of said photoconductive drum at more than one point, said second shifting means being remote from said photoconductive drum so as not to apply pressure directly to said photoconductive drum.

2. The electrophotographic printer according to claim 1, wherein said second shifting means is conductive and grounded, whereby the electrical potential of said recording medium is grounded.

3. The electrophotographic printer according to claim 2, wherein said second shifting means comprises a brush member.

4. The electrophotographic printer according to claim 1, further comprises feed path defining means for regulating said feed path so that said feed path neutrally parts from said photoconductive drum, and wherein said first and second shifting means cause said recording medium to abut against the circumferential surface of said photoconductive drum.

5. The electrophotographic printer according to claim 1, wherein said recording medium is a continuous form recording sheet.

6. The electrophotographic printer according to claim 4, wherein said first shifting means and said second shifting means cause said recording medium to abut against a circumferential surface area of said photoconductive drum.

7. The electrophotographic printer according to claim 1, wherein said first shifting means comprises a pressing guide.

8. The electrophotographic printer according to claim 7, wherein said pressing guide comprises a peaked upper side.

9. The electrophotographic printer according to claim 1, wherein a line connecting portions of said first shifting means and said second shifting means closest to said photoconductive drum intersects the circumferential surface of said electrophotographic drum along an arcuate sector.

10. The electrophotographic printer according to claim 1, wherein said predetermined width comprises a minimum contact width.

11. An electrophotographic printer comprising a photoconductive drum and a transfer charger, with a feed path of a recording medium being defined between said photoconductive drum and said transfer charger, said printer comprising:

first shifting means arranged upstream of said feed path with respect to said transfer charger for shifting said recording medium towards said photoconductive drum by a predetermined amount; and second shifting means arranged downstream of said feed path with respect to said transfer charger for shifting said recording medium towards said photoconductive drum by another predetermined amount;

wherein said first shifting means and said second shifting means further comprise means for causing said recording medium to contact said photoconductive drum, such that a straight line formed by interconnecting said first and second shifting means intersects the circumferential surface of said photoconductive drum at more than one point, said second shifting means being remote from said photoconductive drum so as not to apply pressure directly to said photoconductive drum.

12. The electrophotographic printer of claim 1, wherein said first shifting means is remote from said photoconductive drum so as not to apply pressure directly to said photoconductive drum.

13. The electrophotographic printer of claim 11, wherein said first shifting means is remote from said photoconductive drum so as not to apply pressure directly to said photoconductive drum.

* * * * *